US007701480B2

(12) United States Patent
Omori et al.

(10) Patent No.: US 7,701,480 B2
(45) Date of Patent: Apr. 20, 2010

(54) LIGHT-SOURCE DRIVING DEVICE, OPTICAL SCANNING DEVICE, AND IMAGE FORMING APPARATUS

(75) Inventors: Atsufumi Omori, Kanagawa (JP); Masaaki Ishida, Kanagawa (JP); Yasuhiro Nihei, Kanagawa (JP); Jun Tanabe, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/029,115

(22) Filed: Feb. 11, 2008

(65) Prior Publication Data

US 2008/0225106 A1 Sep. 18, 2008

(30) Foreign Application Priority Data

Mar. 2, 2007 (JP) ..... 2007-052254

(51) Int. Cl.
*B41J 2/435* (2006.01)
*B41J 2/47* (2006.01)

(52) U.S. Cl. ..... 347/237; 347/247

(58) Field of Classification Search ..... 347/132, 347/247, 128, 144, 236, 237, 246; 360/46; 369/59.11; 250/205
See application file for complete search history.

(56) References Cited

U.S. PATENT DOCUMENTS 5,726,437 A * 3/1998 Ashikaga et al. ..... 250/205
6,388,689 B1 * 5/2002 Toda et al. ..... 347/132
6,727,934 B2 * 4/2004 Suda ..... 347/247
6,791,596 B2 9/2004 Nihei et al.
6,927,789 B2 8/2005 Ozasa et al.
6,933,957 B2 8/2005 Omori et al.
6,954,415 B2 * 10/2005 Masui et al. ..... 369/59.11
6,967,797 B2 * 11/2005 Sako ..... 360/46
7,212,224 B2 5/2007 Nihei et al.
7,256,815 B2 8/2007 Suzuki et al.
7,271,824 B2 9/2007 Omori et al.
7,283,151 B2 10/2007 Nihei et al.
7,327,379 B2 2/2008 Nihei et al.
2005/0089069 A1 4/2005 Ozasa et al.
2005/0219354 A1 10/2005 Omori et al.
2005/0243163 A1 11/2005 Ozasa et al.
2006/0209170 A1 9/2006 Nihei
2006/0285186 A1 12/2006 Ishida et al.
2007/0030548 A1 2/2007 Nihei et al.
2007/0091163 A1 4/2007 Omori et al.
2007/0132828 A1 6/2007 Ishida et al.
2007/0285495 A1 12/2007 Nihei et al.

FOREIGN PATENT DOCUMENTS

JP 03030376 A * 2/1991
JP 2000-12973 1/2000
JP 2002-217488 8/2002
JP 2002-314191 10/2002

* cited by examiner

*Primary Examiner*—Hai C Pham
(74) *Attorney, Agent, or Firm*—Oblon, Spivak, McClelland, Maier & Neustadt, L.L.P.

(57) ABSTRACT

A circuit for driving a plurality of light emitting units includes a current biasing unit that biases a light emitting current with an overshoot current and supplies the resultant current to each of the light emitting units. The light emitting current is determined based on an amount of light emitted from each of the light emitting units.

8 Claims, 15 Drawing Sheets

$\tau 1 = R1 \times C1$
$\tau 2 = R2 \times C2$
$\tau 3 = R3 \times C3$

C1<C2<C3, WHEN R1≒R2≒R3 AND
LENGTH OF L1<LENGHT OF L2<LENGTH OF L3

LIGHT-SOURCE DRIVING DEVICE, OPTICAL SCANNING DEVICE, AND IMAGE FORMING APPARATUS

CROSS-REFERENCE TO RELATED APPLICATIONS

The present application claims priority to and incorporates by reference the entire contents of Japanese priority document 2007-052254 filed in Japan on Mar. 2, 2007.

BACKGROUND OF THE INVENTION

1. Field of the Invention

The present invention relates to a light-source driving device for driving a plurality of light emitting units in an image forming apparatus.

2. Description of the Related Art

An electrophotographic image forming apparatus that employs a laser as a light source is widely used for forming an image on a recording medium. Typically, the image forming apparatus includes an optical scanning device that forms an electrostatic latent image on a photosensitive drum by scanning the photosensitive drum with a laser beam in an axis direction of the photosensitive drum via a polygon scanner (e.g., a polygon mirror) while the photosensitive drum rotates. There has been a demand to increase image density, processing speed, and image quality, and improve operability of image forming apparatuses.

For this purpose, a method of scanning a plurality of lines on the photosensitive drum with a plurality of laser beams simultaneously has been proposed.

For example, an image forming apparatus disclosed in Japanese Patent Application Laid-open No. 2000-012973 includes a light emitting element array in which a plurality of light emitting elements, to which a first electrode and a second electrode for applying a current are connected, are two-dimensionally arranged in a rectangular area, and first wires as a row wiring aligned in a longitudinal direction of the rectangular area and second wires as a column wiring aligned in a lateral direction of the rectangular area are arranged in a matrix form. The first electrodes are connected to the first wires, and the second electrodes are connected to the second wires. The light emitting element array is divided into a plurality of groups each of which can be driven independently, the row wiring and the column wiring are provided for the light emitting elements in each group, and the wires in the row wiring are drawn in the column direction.

Moreover, a light emitting element array disclosed in Japanese Patent Application Laid-open No. 2002-314191 includes a plurality of light emitting elements arranged on a substrate and a plurality of electrode pads that are individually connected to the light emitting elements through a plurality of wires provided on the substrate. In the light emitting element array, the stray capacitances of the wires are approximately the same.

In recent years, attention has been paid to the use of a surface-emitting laser element as a light source of an image forming apparatus, such as a vertical-cavity surface emitting laser (VCSEL) element.

For example, a VCSEL element disclosed in Japanese Patent Application Laid-open No. 2002-217488 includes a multiple quantum well (MQW) structure between an active layer and a top mirror, a first electrode for injecting a current into the active layer, and a second electrode for applying an electric field into the MQW structure. The electric field is applied to the MQW structure, so that a refractive index of the MQW structure is changed, thereby making an oscillation wavelength variable. A GaInNAs compound crystal is used as a material of a well layer of the MQW structure in the surface-emitting laser element.

If a light source including a plurality of light emitting units and a driver for supplying a driving current to each light emitting unit are provided on the same substrate and a wiring is conducted between the light source and the driver, it becomes difficult to keep the length of each wire the same between each light emitting unit and the driver as the number of the light emitting units increases.

If the lengths of the wires are different, rise characteristics of lights emitted from the light emitting units differ from each other. In addition, fluctuation in the rise characteristics can arise due to fluctuation in characteristics between the light emitting units, such as thermal characteristics and a resistance.

SUMMARY OF THE INVENTION

It is an object of the present invention to at least partially solve the problems in the conventional technology.

According to an aspect of the present invention, there is provided a circuit for driving a plurality of light emitting units that includes an overshoot-current generating unit that generates an overshoot current; and a current adding unit that biases a light emitting current that is determined based on an amount of light emitted from each of the light emitting units with the overshoot current, and supplies resultant current to each of the light emitting units.

According to another aspect of the present invention, there is provided an optical scanning device that scans a target surface with a light. The optical scanning device including a light source that includes a plurality of light emitting units; a deflector that deflects the light emitted from the light source; an optical system that focuses the light deflected by the deflector toward the target surface; and the circuit for driving the light emitting units, the circuit including an overshoot-current generating unit that generates an overshoot current; and a current adding unit that biases a light emitting current that is determined based on an amount of light emitted from each of the light emitting units with the overshoot current, and supplies resultant current to each of the light emitting units.

According to still another aspect of the present invention, there is provided an image forming apparatus including at least one image carrier; and at least one optical scanning device that scans the at least one image carrier with a light carrying image data. The optical scanning device including a light source that includes a plurality of light emitting units; a deflector that deflects the light emitted from the light source; an optical system that focuses the light deflected by the deflector toward the target surface; and a circuit for driving the light emitting units. The circuit including an overshoot-current generating unit that generates an overshoot current; and a current adding unit that biases a light emitting current that is determined based on an amount of light emitted from each of the light emitting units with the overshoot current, and supplies resultant current to each of the light emitting units.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
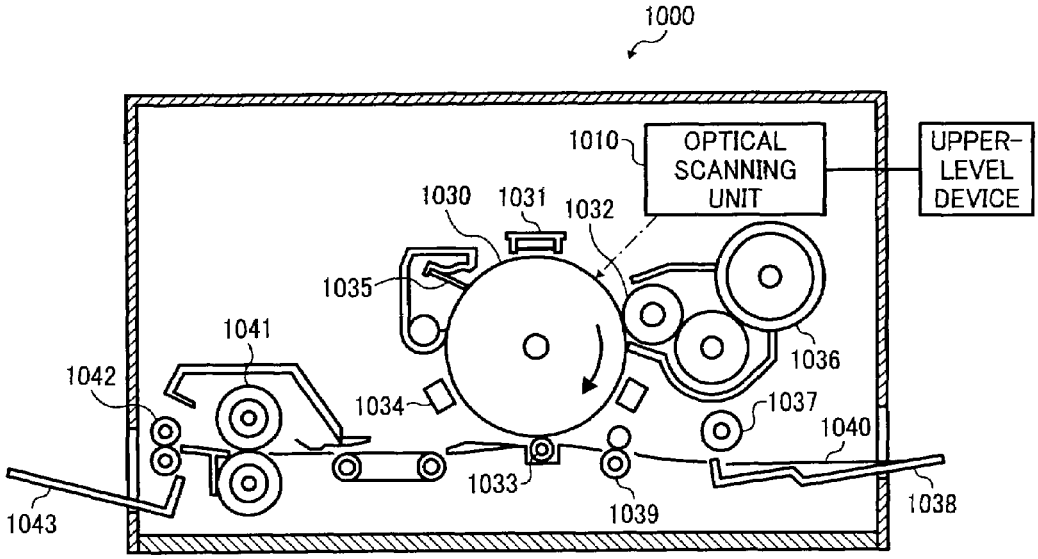
FIG. 1 is a schematic diagram of a laser printer according to an embodiment of the present invention.

FIG. 1 is a schematic diagram of a laser printer 1000 as an image forming apparatus according to one embodiment of the present invention. The laser printer 1000 includes an optical scanning unit 1010, a photosensitive drum 1030, a charging unit 1031, a developing roller 1032, a transfer charger 1033, a neutralizing unit 1034, a cleaning blade 1035, a toner cartridge 1036, a feeding roller 1037, a feeding tray 1038, a pair of registration rollers 1039, a fixing roller 1041, a discharging roller 1042, and a discharge tray 1043.

A photosensitive layer is formed on the surface of the photosensitive drum 1030, and the surface of the photosensitive drum 1030 is scanned with light. The photosensitive drum 1030 rotates in a direction indicated by an arrow in FIG. 1.

The charging unit 1031, the developing roller 1032, the transfer charger 1033, the neutralizing unit 1034, and the cleaning blade 1035 are arranged in this order along the direction of rotation of the photosensitive drum 1030 and near the surface of the photosensitive drum 1030.

The charging unit 1031 uniformly charges the surface of the photosensitive drum 1030.

The optical scanning unit 1010 irradiates the uniformly charged surface of the photosensitive drum 1030 with light that is modulated based on image data sent from an upper-level device such as a personal computer. As a result, an electrostatic latent image representing the image data is formed on the surface of the photosensitive drum 1030. The latent image moves toward the developing roller 1032 with the rotation of the photosensitive drum 1030.

The developing roller 1032 picks-up some toner from the toner cartridge 1036 and applies the toner to the surface of the photosensitive drum 1030. The toner adheres to the latent image on the surface of the photosensitive drum 1030 thereby developing the latent image. The latent image with the toner adhered thereto, hereinafter "toner image", moves toward the transfer charger 1033 with the rotation of the photosensitive drum 1030.

Recording sheets 1040 are stacked in the feeding tray 1038. The feeding roller 1037, which is arranged near the feeding tray 1038, picks up the recording sheets 1040 one by one from the feeding tray 1038, and feeds it to the registration rollers 1039. The registration rollers 1039 arranged near the transfer charger 1033 temporarily holds the recording sheet 1040 picked up by the feeding roller 1037, and feeds the recording sheet 1040 to a space between the photosensitive drum 1030 and the transfer charger 1033 in synchronization with the rotation of the photosensitive drum 1030.

The transfer charger 1033 is applied with a voltage opposite in polarity to the toner, so that the toner on the surface of the photosensitive drum 1030 is electrically attracted to the recording sheet 1040, thereby transferring the toner image onto the recording sheet 1040. The recording sheet 1040 with the toner image transferred thereon is fed into the fixing roller 1041.

The fixing roller 1041 applies heat and pressure to the recording sheet 1040 whereby the toner image is fixed to the recording sheet 1040. The recording sheet 1040 with the toner image fixed thereto is discharged into the discharge tray 1043 by the action of the discharging roller 1042. Thus, recording sheets 1040 with the toner image fixed thereto are sequentially stacked on the discharge tray 1043.

The neutralizing unit 1034 neutralizes the surface of the photosensitive drum 1030.

The cleaning blade 1035 removes toner (residual toner) remaining on the surface of the photosensitive drum 1030. The residual toner removed is reused. The surface of the photosensitive drum 1030 from which the residual toner is removed is moved back to the position of the charging unit 1031 again.

The configuration of the optical scanning unit 1010 is explained below. A Y-axis direction corresponds to a main-scanning direction, a Z-axis direction corresponds to a sub-scanning direction, and an X-axis direction corresponds to a direction that is perpendicular to the Y-axis direction and the Z-axis direction.

Figure 2:
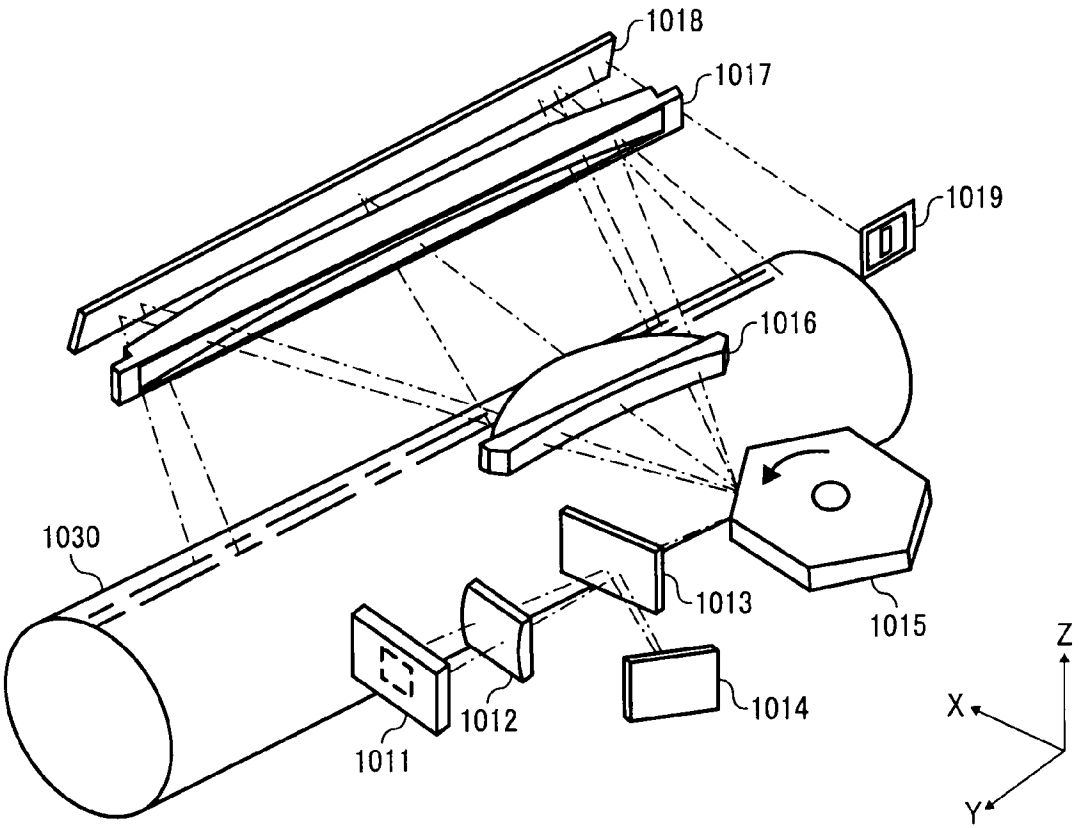
FIG. 2 is a schematic diagram of an optical scanning unit shown in FIG. 1.

As shown in FIG. 2, the optical scanning unit 1010 includes a light-source unit 1011, a cylindrical lens 1012, a half mirror 1013, a light receiving element 1014, a polygon mirror 1015, an fθ lens 1016, a toroidal lens 1017, a reflecting mirror 1018, and a synchronization (sync) sensor 1019.

The light-source unit 1011 includes a light source LA having a plurality of light emitting units, a control unit 400 that controls the light source LA, and a coupling lens CL.

Figure 3:
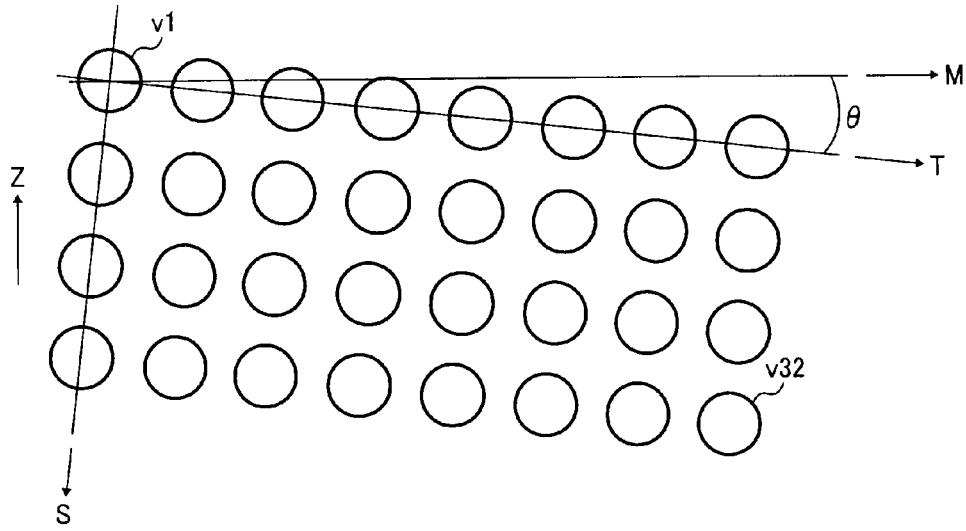
FIG. 3 is a schematic diagram of an array of a plurality of light emitting units.

As shown in FIG. 3, the light source LA, for example, includes a two-dimensional VCSEL array in which 32 light emitting units are formed on a substrate.

As shown in FIG. 3, the two-dimensional array has four rows of light emitting units. In each of the rows, eight light emitting units are aligned at equal intervals in a T direction that is inclined by an angle θ with respect to a direction corresponding to the main-scanning direction (hereinafter, "M direction") toward the Z direction that is the sub-scanning direction. The four rows are aligned at equal intervals in a direction (hereinafter, "S direction") perpendicular to the T direction. In other words, 32 light emitting units are two-dimensionally aligned along the T direction and the S direction. For the sake of explanation, the four rows are denoted as a first light-emitting-unit row, a second light-emitting-unit row, a third light-emitting-unit row, and a fourth light-emitting-unit row from top to bottom in FIG. 3. The term "a light-emitting-unit interval" denotes an interval between the centers of two adjacent light emitting units.

For the sake of explanation, the light emitting units in the first light-emitting-unit row are given reference numerals v1 to v8, the light emitting units in the second light-emitting-unit row are given reference numerals v9 to v16, the light emitting units in the third light-emitting-unit row are given reference numerals v17 to v24, and the light emitting units in the fourth light-emitting-unit row are given reference numerals v25 to v32, from left to right in FIG. 3.

The coupling lens CL makes the light emitted from the light source LA into an approximately parallel light, so that the approximately parallel light is output from the light-source unit 1011.

As shown in FIG. 2, the cylindrical lens 1012 focuses the light from the light-source unit 1011 on an area near a deflection surface of the polygon mirror 1015 with respect to the sub-scanning direction.

The half mirror 1013 is arranged on the light path between the cylindrical lens 1012 and the polygon mirror 1015, and reflects a part of the light that passes through the cylindrical lens 1012. The ratio of the amount of light between a transmitted light and a reflected light at the half mirror 1013 is set to any one of 9:1, 8:2, and 7:3.

The polygon mirror 1015 is formed of a regular hexagonal cylindrical member that is low in height, and a deflection surface is formed on each of the six sides. The polygon mirror 1015 is rotated at a constant angular velocity in a direction indicated by an arrow in FIG. 2 by a rotation mechanism (not shown), so that the light that is radiated from the light-source unit 1011 and is focused on an area near the deflection surface of the polygon mirror 1015 by the cylindrical lens 1012 is deflected at the constant angular velocity.

The fθ lens 1016 has an image height proportional to an incident angle of the light from the polygon mirror 1015, and moves an image plane of the light deflected by the polygon mirror 1015 at a constant rate in the main scanning direction.

The light transmitted through the fθ lens 1016 is imaged on the surface of the photosensitive drum 1030 through the toroidal lens 1017 and the reflecting mirror 1018.

The sync sensor 1019 is arranged at a position of the same level as the image plane, at which the light just before scanning, which is reflected by the reflecting mirror 1018, enters. The sync sensor 1019 outputs a signal (an optical-to-electrical conversion signal) corresponding to the amount of light received. Therefore, the start of the scanning on the photosensitive drum 1030 can be detected based on the output signal from the sync sensor 1019.

The light receiving element 1014 is arranged on the optical path of the light reflected by the half mirror 1013, and outputs a signal (an optical-to-electrical conversion signal) corresponding to the amount of light received.

Figure 4:
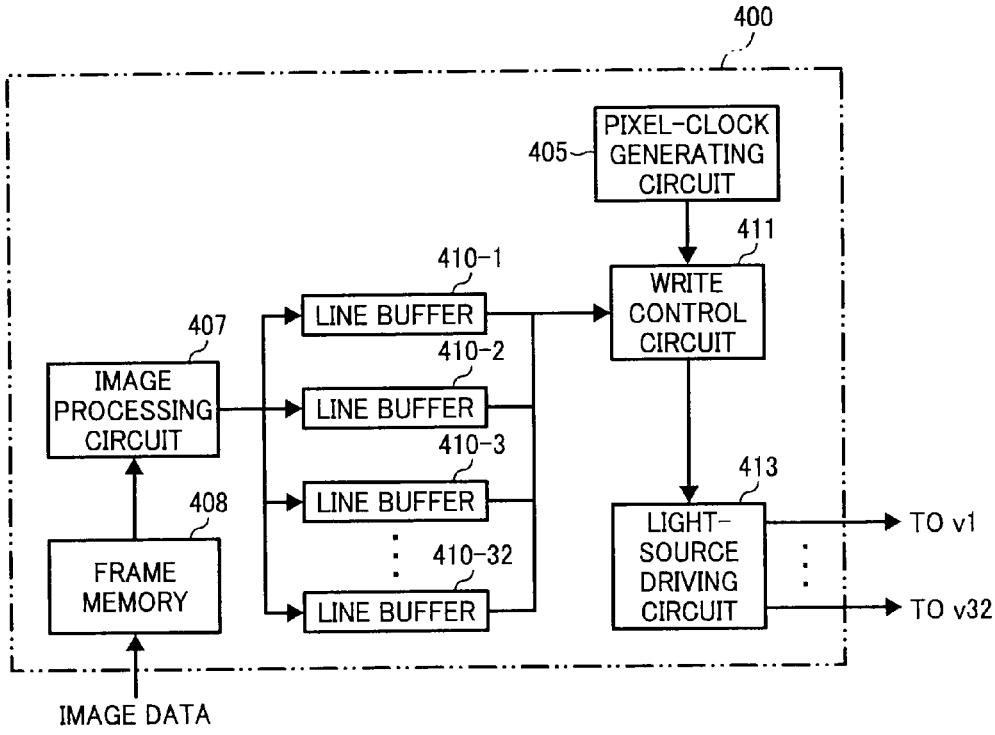
FIG. 4 is a block diagram of a control unit of a light-source unit.

As shown in FIG. 4, the control unit 400 includes a pixel-clock generating circuit 405, an image processing circuit 407, a frame memory 408, line buffers 410-1 to 410-32, a write control circuit 411, and a light-source driving circuit 413. Arrows in FIG. 4 indicate flows of typical signals and data, and do not indicate all the connection relations between the components.

The pixel-clock generating circuit 405 generates an image clock signal.

The frame memory 408 temporarily stores image data that was subjected to a raster development (hereinafter, "a raster data").

The image processing circuit 407 reads out the raster data stored in the frame memory 408, generates write data for the light emitting units after performing a predetermined halftone process and the like, and outputs them to the corresponding line buffers 410-1 to 410-32.

When the write control circuit 411 detects the start of the scanning based on the output signals from the sync sensor 1019, the write control circuit 411 reads out the write data for each light emitting unit from each of the line buffers 410-1 to 410-32, superposes the write data for each light emitting unit on an image clock signal from the pixel-clock generating circuit 405 to generate specific modulated data for each light emitting unit.

Figure 5:
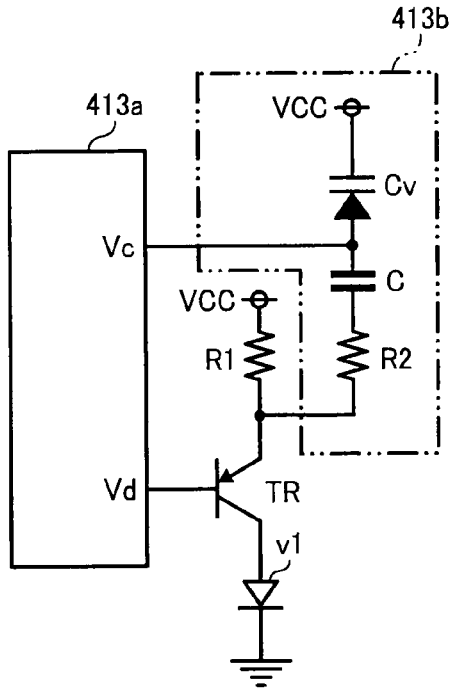
FIG. 5 is a circuit diagram of a light-source driving circuit shown in FIG. 4.

The light-source driving circuit 413 includes a light-source driver 413*a* and overshoot-current generating circuits 413*b*. In FIG. 5, only the light-source driver 413*a* and the overshoot-current generating circuit 413*b* for the light emitting unit v1 are shown for easy understanding.

The light-source driver 413*a* applies a drive voltage Vd to a base of a transistor TR that is connected to each light emitting unit, based on the modulated data from the write control circuit 411. Therefore, a light emitting current corresponding to the drive voltage Vd is supplied to each light emitting unit.

The overshoot-current generating circuit 413*b* includes an RC circuit formed by combining a resistor R2, a capacitor C, and a variable capacitance diode Cv as a variable capacitance element, and an RC circuit constant of the RC circuit can be changed by changing the capacitance of the variable capacitance diode Cv by a control voltage Vc from the light-source driver 413*a*. An amplitude of an overshoot current generated by the overshoot-current generating circuit 413*b* is determined according to the ratio between a resistance of the resistor R1 and a resistance of the resistor R2. The overshoot current generated is added to the light emitting current.

The light-source driving circuit 413 adjusts the drive voltage Vd based on the output signals of the light receiving element 1014 every predetermined timing so that the intensity of the light emitted from each light emitting unit is approximately constant.

There are various kinds of packages for providing a light-source driver on a substrate (in some cases, referred to as "integrated circuit (IC) packages") and packages for providing a light source on a substrate (in some cases, referred to as "light-source packages") such as a ball grid array (BGA) and a quad flat package (QFP). Pins on any package have parasitic capacitances, and wires have coupling capacitances depending upon a width between wires and a wiring pattern. Therefore, even when an ideal rectangular current (or voltage) is generated in the light-source driver, an RC circuit is created by the above capacitances and a resistance of the light source. Consequently, the waveform of the light emitting current supplied to each light emitting unit is distorted by a time constant t calculated by R×C.

The time constant t is almost the same between pins in an IC package and between pins in a light-source package; however, the length of all wires for connecting both packages on the substrate may not be the same due to the limitation in layout on the substrate. Therefore, there is a high possibility that the coupling capacitance is different in each light emitting unit.

For example, if a light source including a two-dimensional VCSEL array is used as the light source with a plurality of light emitting units, the resistance may be different between the light emitting units because of a device-by-device fluctuation of the VCSEL elements or the arrangement pattern of the VCSEL elements.

Because the time constant depends on the resistance and the capacitance, the rise characteristics of the light emitting current supplied to each light emitting unit vary, which causes an optical waveform to vary. When the lights with different optical waveforms are used in the optical scanning unit, the amount of light for scanning varies. Moreover, when the lights with different optical waveforms are used in the image forming apparatus, unevenness occurs in density of an image, making it difficult to form an image with high quality.

Figure 6:
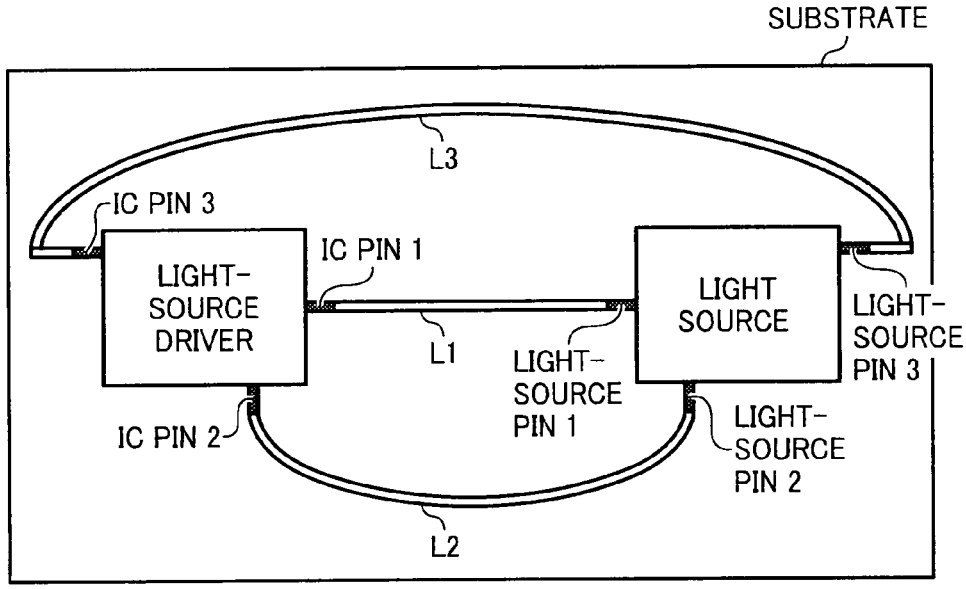
FIG. 6 is a schematic diagram of a light-source driver, a light source, a substrate on which the light-source driver and the light source are provided, and wires for connecting the light-source driver and the light source on the substrate.

FIG. 6 is a schematic diagram of the light-source driver, the light source including light emitting units 1 to 3 (refer to FIG. 7), the substrate on which the light-source driver and the light source are provided, and the wires L1 to L3 for electrically connecting the light-source driver and the light emitting units. The IC package for supplying the light emitting current to the light emitting units 1 to 3 includes IC pins 1 to 3, and the light-source package includes light-source pins 1 to 3. The wire L1 connects the IC pin 1 and the light-source pin 1, the wire L2 connects the IC pin 2 and the light-source pin 2, and the wire L3 connects the IC pin 3 and the light-source pin 3.

Figure 7:
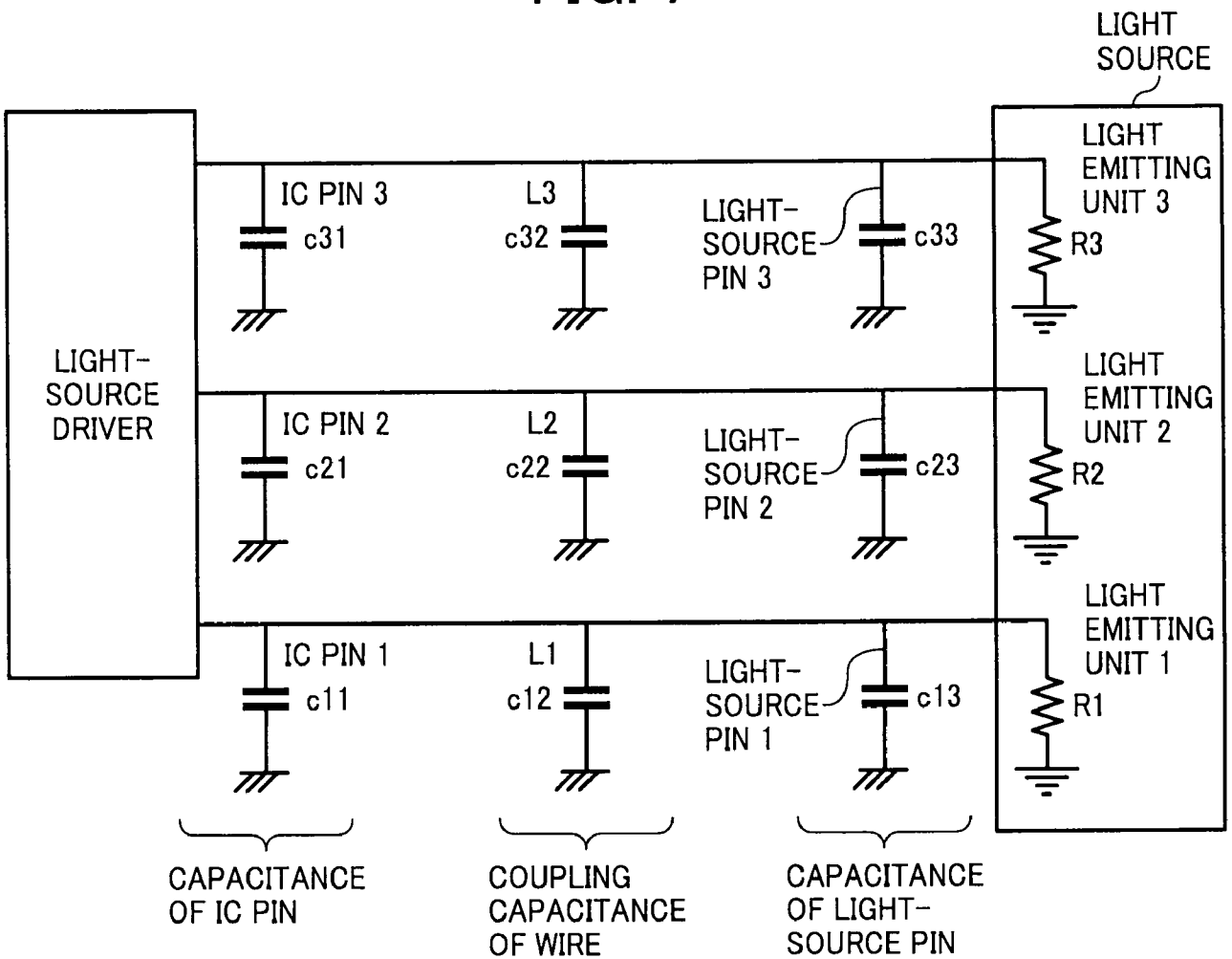
FIG. 7 is a schematic diagram for explaining capacitances of the IC pins in an IC package, coupling capacitances of the wires, and capacitances of the light-source pins in a light-source package in FIG. 6.

FIG. 7 is a schematic diagram of capacitances C11, C21, and C31 of the IC pins 1 to 3, coupling capacitances C12, C22, and C32 of the wires L1 to L3, capacitances C13, C23, and C33 of the light-source pins 1 to 3, and resistances R1, R2, and R3 of the light emitting units 1 to 3.

A capacitance C1 (C11+C12+C13) is applied to a channel from the light-source driver to the light emitting unit 1, so that the time constant t1=R1×C1 occurs in the channel. For example, if C11=2 pF, C12=1 pF, C13=2 pF, and R1=300 O, t1 is about 1.5 ns.

Figure 8:
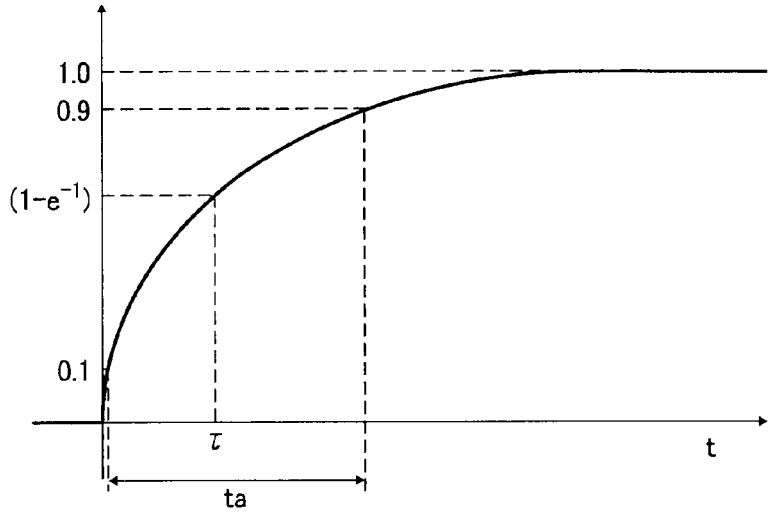
FIG. 8 is a graph of a relation between a time constant and rise characteristics.

FIG. 8 is a graph representing a relation between the time constant and the rise characteristics. For example, when a constant pulse current is applied to the light emitting unit with a unity absolute value, the time constant t indicates the timing at which an amplitude of the current is $(1-e^{-1})$. When the rise characteristics are calculated by the 10%-90% method, a rise time ta indicates the time during which an amplitude of the current changes from 0.1 to 0.9. Response characteristics of a pulsed waveform are easily understood by considering the rise characteristics. The relation between the rise characteristics and the time constant is defined by ta=2.2×t based on a relational equation between the response characteristics and the rise characteristics. The same goes for a fall time.

Therefore, the rise time ta in this example is about 3.3 ns.

A capacitance C2 (C21+C22+C23) is applied to a channel from the light-source driver to the light emitting unit 2, so that the time constant t2=R2×C2 occurs in the channel. For example, if C21=2 pF, C22=2 pF, C23=2 pF, and R2=300 O, t2 is about 1.8 ns. The rise time ta in this example is about 3.96 ns.

Therefore, if the coupling capacitance of a wire changes from 1 pF to 2 pF, the rise time ta changes about 0.7 ns.

Figure 9A:
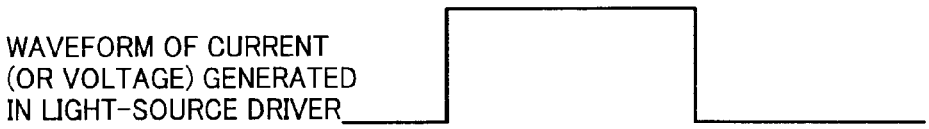
FIG. 9A is a waveform of a current (or a voltage) generated in the light-source driver.
Figure 9B:
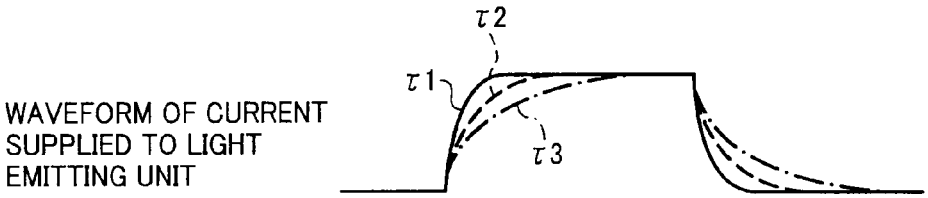
FIG. 9B is a waveform of a current supplied to the light emitting unit.

FIG. 9A is a waveform schematically representing a current (or a voltage) generated in the light-source driver, and FIG. 9B is a waveform schematically representing a current supplied to the light emitting units through the wires. For example, if length of the wire L1<length of the wire L2<length of the wire L3, and the capacitances of the IC pins, the capacitances of the light-source pins, and the resistances of the light emitting units are each do not show much difference among the light emitting units, the waveform of the current supplied to the light emitting unit through the shortest wire (the wire L1) shows the best rise characteristics, and a distortion in the waveform increases in the longer wires (the wires L2 and L3).

Figure 10A:
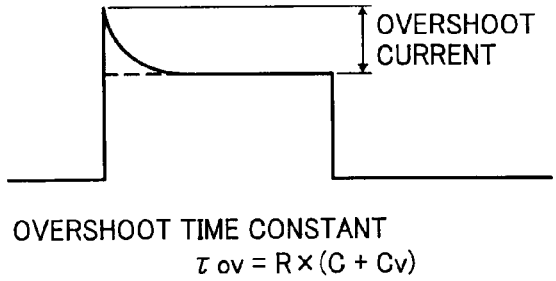
FIGS. 10A and 10B are waveforms for explaining a procedure of correcting the rise characteristics of the light emitting unit by adding an overshoot current.
Figure 10B:
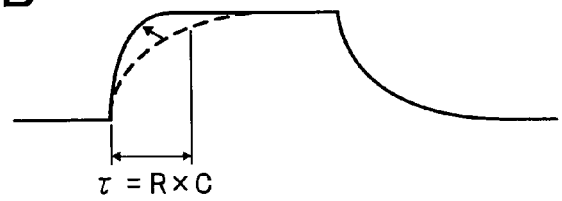

In the present embodiment, as shown in FIG. 10A as one example, an overshoot current is added to the light emitting current that is determined based on the light emitting amount with an overshoot time constant tov. Therefore, the rise characteristics of the current supplied to the light emitting unit can be improved as indicated by a solid line in FIG. 10B as one example. Dotted lines in FIG. 10B represent the rise characteristics of the currents in the case in which the overshoot current is not added to the currents.

When the RC circuit is used as a circuit for generating the overshoot current, the peak value and the time constant of the overshoot current to be generated are determined according to the resistance and the capacitance of the circuit.

In the overshoot-current generating circuit 413*b*, an amplitude of the overshoot current is determined according to the combination of the resistors R1 and R2, and an adding time during which the overshoot current is added is determined according to the time constant of the RC circuit.

In the overshoot-current generating circuit 413*b*, each of the resistances and capacitances is set so that the time constant calculated based on the capacitances of the IC pins, the coupling capacitances of the wires, the capacitances of the light-source pins, and the resistances of the light emitting units is approximately the same in each light emitting unit.

The light-source driving circuit 413 includes the light-source driver 413*a* for applying the drive voltage Vd to the base of the transistor TR connected to each light emitting unit based on the modulation data from the write control circuit 411 and the overshoot-current generating circuit 413*b* that includes the RC circuit constituted by combining the resistor R2, the capacitor C, and the variable-capacitance diode Cv. Because of such a configuration, it is possible to add an overshoot current to a light emitting current determined from a light emitting amount. As a result, it is possible to make the rise characteristics of all the light emitting units substantially same.

The optical scanning unit 1010 includes the control unit 400 that in turn includes the light-source driving circuit 413. As a result, it is possible to suppress fluctuation of the light emitting amount between the light emitting units and enhance the accuracy of optical scanning.

The laser printer 1000 includes the optical scanning unit 1010. As a result, it is possible to increase the image quality and processing speed.

If the capacitances of the IC pins, the capacitances of the light-source pins, and the resistances do not differ much among the light emitting units, it is conceivable to set the resistances and the capacitances in the overshoot-current generating circuit 413*b* depending on the length of the wire between the light emitting unit and the overshoot-current generating circuit 413*b*.

Furthermore, if the capacitances of the IC pins, the coupling capacitances of the wires, and the capacitances of the light-source pins do not differ much among the light emitting units, it is conceivable to set the resistances and the capacitances in the overshoot-current generating circuit 413*b* depending on the resistance of the light emitting unit.

Figure 11:
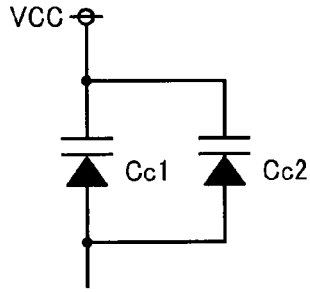
FIG. 11 is a schematic diagram of a modification of a variable capacitance diode shown in FIG. 5.
Figure 12:
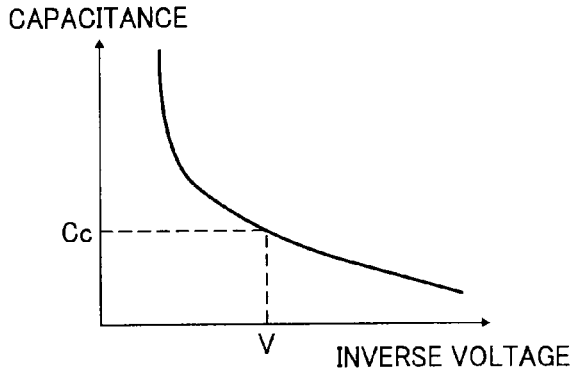
FIG. 12 is a graph representing characteristics of the variable capacitance diode.

Moreover, in the present embodiment, a plurality of variable capacitance diodes can be combined and used instead of the variable capacitance diode Cv. For example, as shown in FIG. 11, a combination of two variable capacitance diodes Cc1 and Cc2 having characteristics represented in FIG. 12 can be used instead of the variable capacitance diode Cv. How to combine a plurality of variable capacitance diodes has been disclosed in Japanese Patent Application Laid-open No. 2006-261461.

Figure 13:
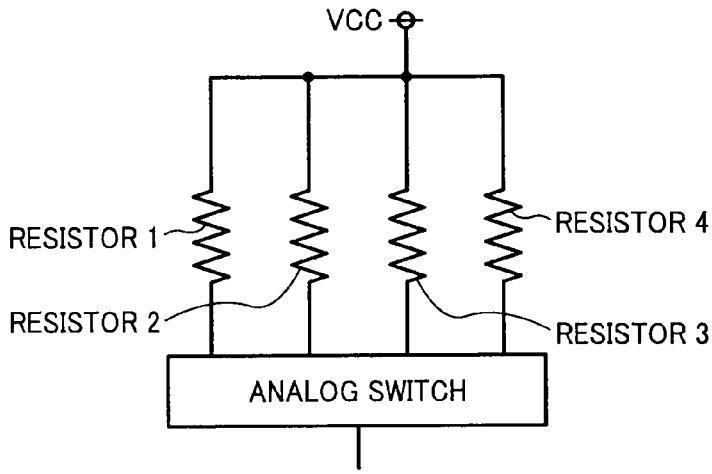
FIG. 13 is schematic diagram of a modification of a resistor in a resistor-capacitor (RC) circuit shown in FIG. 5.

Furthermore, in the present embodiment, the overshoot-current generating circuit 413*b* can be configured such that the resistance in the overshoot-current generating circuit 413*b* is changed by an analog switch that works as a resistance switching unit as shown in FIG. 13 as one example. With this configuration, an amplitude of the overshoot current and the time constant can be changed.

Figure 14:
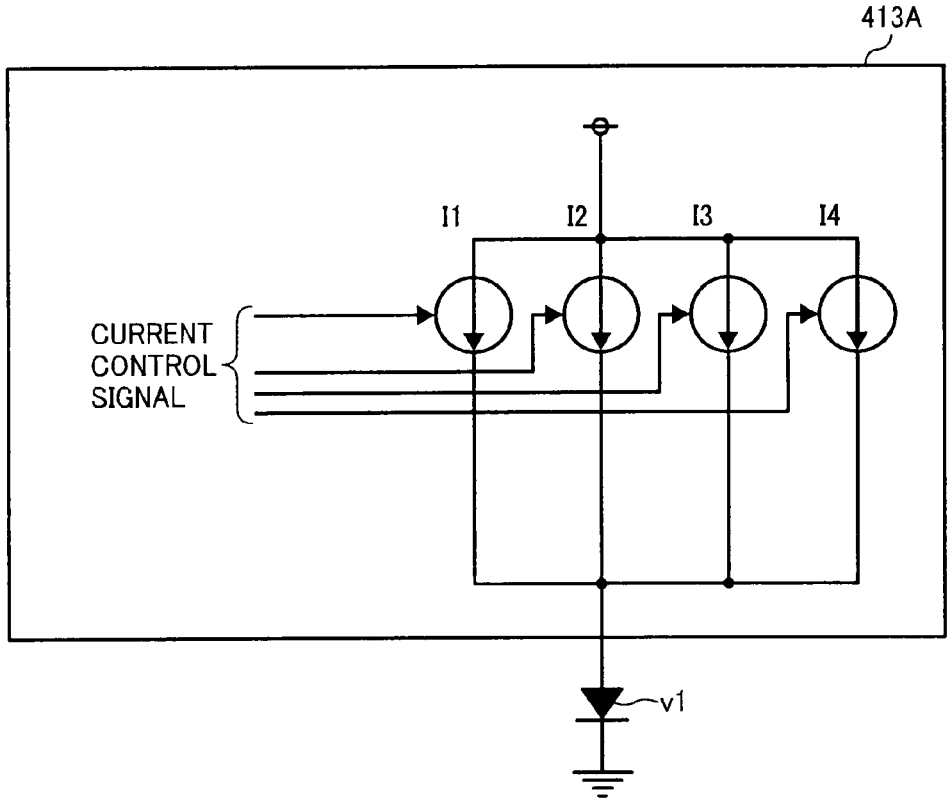
FIG. 14 is a schematic diagram of a modification of the light-source driving circuit.

Moreover, in the present embodiment, a light-source driving circuit 413A including a current-adding-type circuit can be used instead of the light-source driving circuit 413 as shown in FIG. 14. The current-adding-type circuit, for example, includes current sources I1, I2, I3, and I4, and an amplitude of the overshoot current and a current adding timing are controlled by a current control signal.

Figure 15:
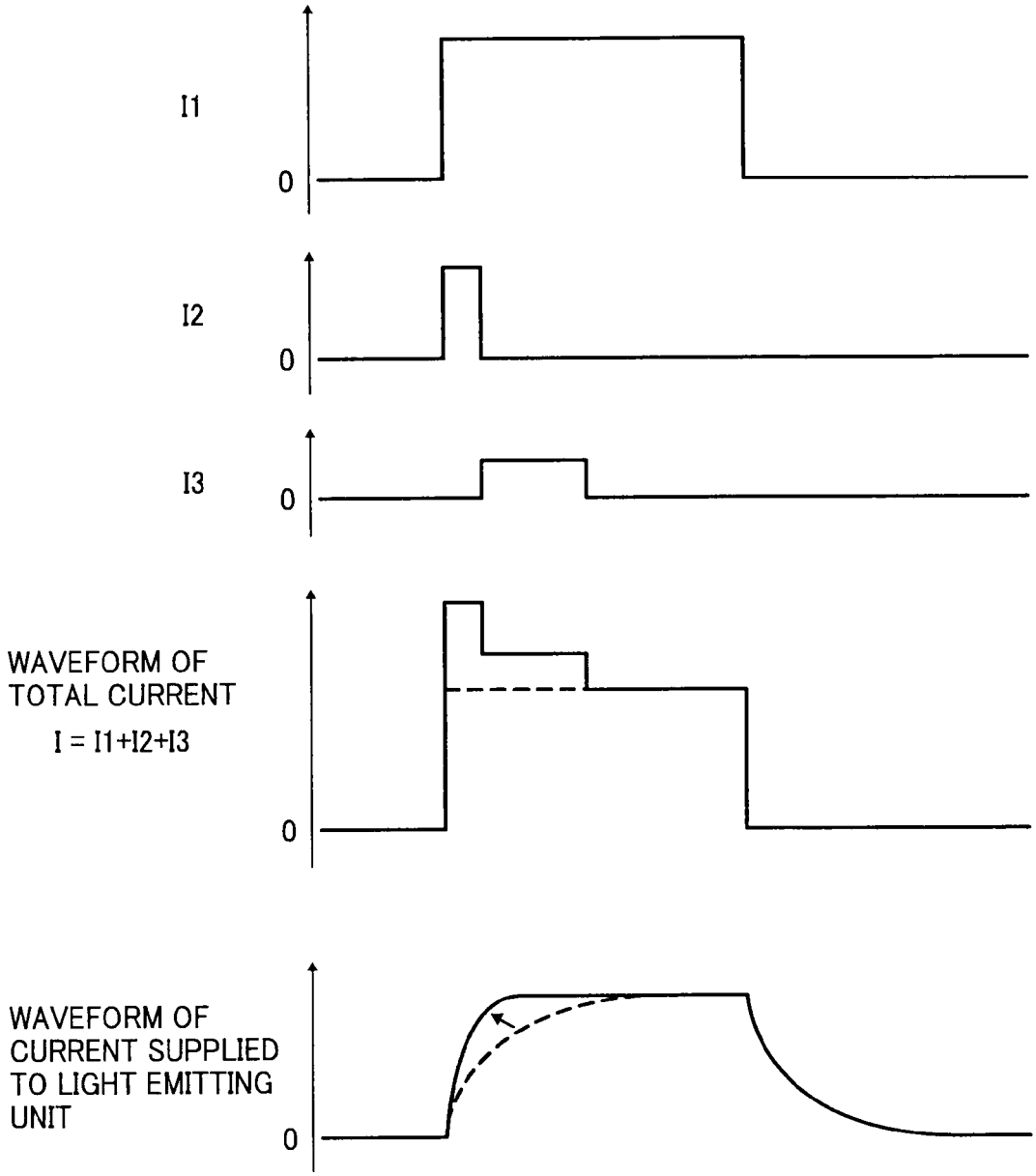
FIG. 15 is a schematic diagram for explaining a method of adding the overshoot current in the light-source driving circuit shown in FIG. 14.
Figure 16:
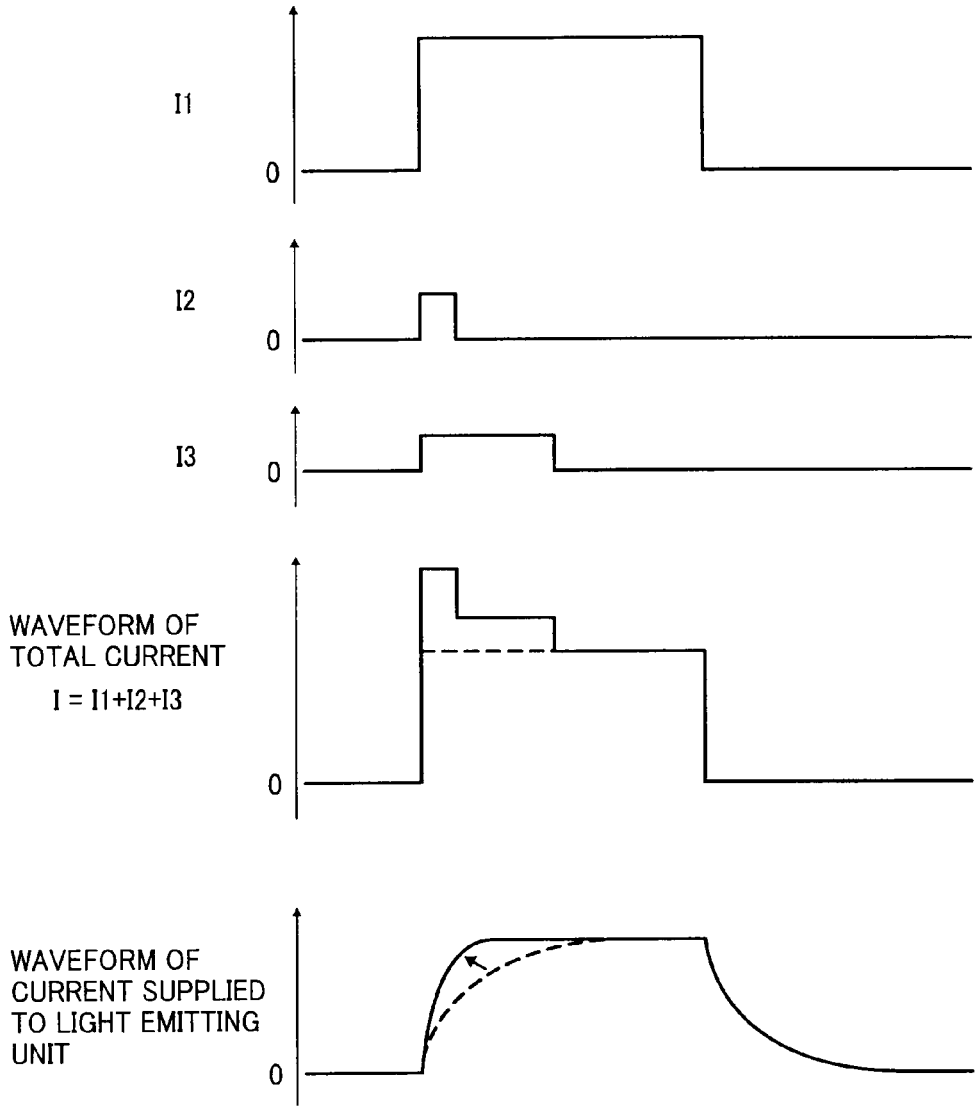
FIG. 16 is a schematic diagram for explaining another method of adding the overshoot current in the light-source driving circuit shown in FIG. 14.

FIGS. 15 and 16 are schematic diagrams representing methods of adding the overshoot current using the current-adding-type circuit. In this case, the distortion of the current can be corrected in digital fashion by controlling each current source by the current control signal so that a total current I takes the maximum value just after the rise of the current and takes a predetermined value (a light emitting current determined according to the light emitting amount) as the time elapses.

FIG. 15 represents a case in which the current sources I2 and I3 are turned on at different timings. FIG. 16 represents a case in which the current sources I2 and I3 are turned on at the same timing.

Figure 17A:
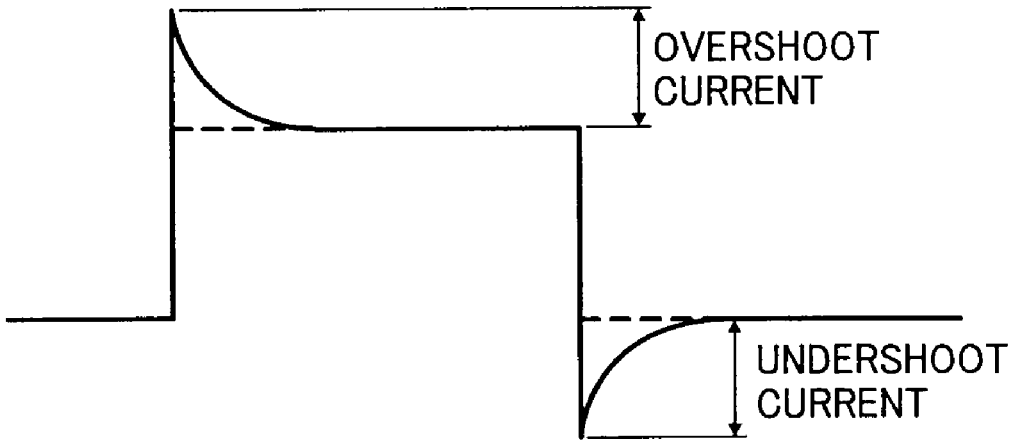
FIGS. 17A and 17B are waveforms for explaining a procedure of correcting the rise characteristics of the light emitting unit by adding the overshoot current and an undershoot current.
Figure 17B:
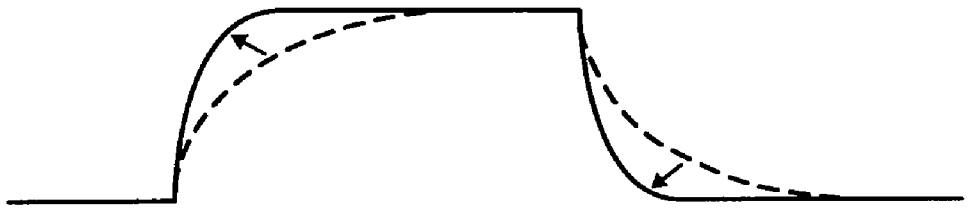

Although only the overshoot current is added to the light emitting current in the present embodiment, an undershoot current can also be added to the light emitting current as shown in FIG. 17A as one example. Therefore, the rise characteristics of the light emitting units can be approximately equal to each other as shown in FIG. 17B as one example.

Figure 18:
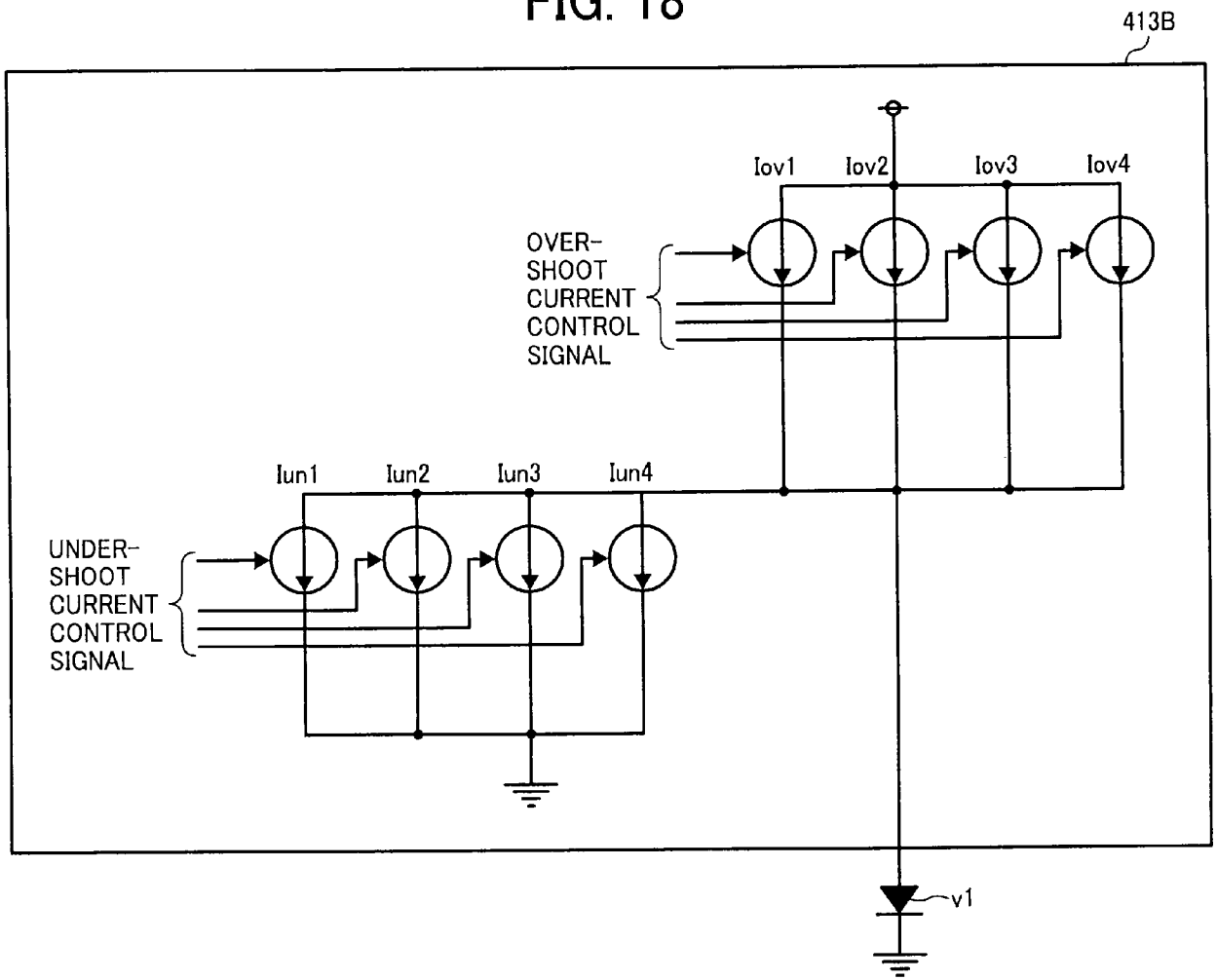
FIG. 18 is a schematic diagram of a light-source driving circuit suitable for adding the overshoot current and the undershoot current.

In this case, as shown in FIG. 18, a light-source driving circuit 413B including a current-adding-type circuit can be used. The current-adding-type circuit includes current sources Iov1, Iov2, Iov3, and Iov4 controlled by an overshoot-current control signal, and current sources Iun1, Iun2, Iun3, and Iun4 controlled by an undershoot current control signal.

Figure 19:
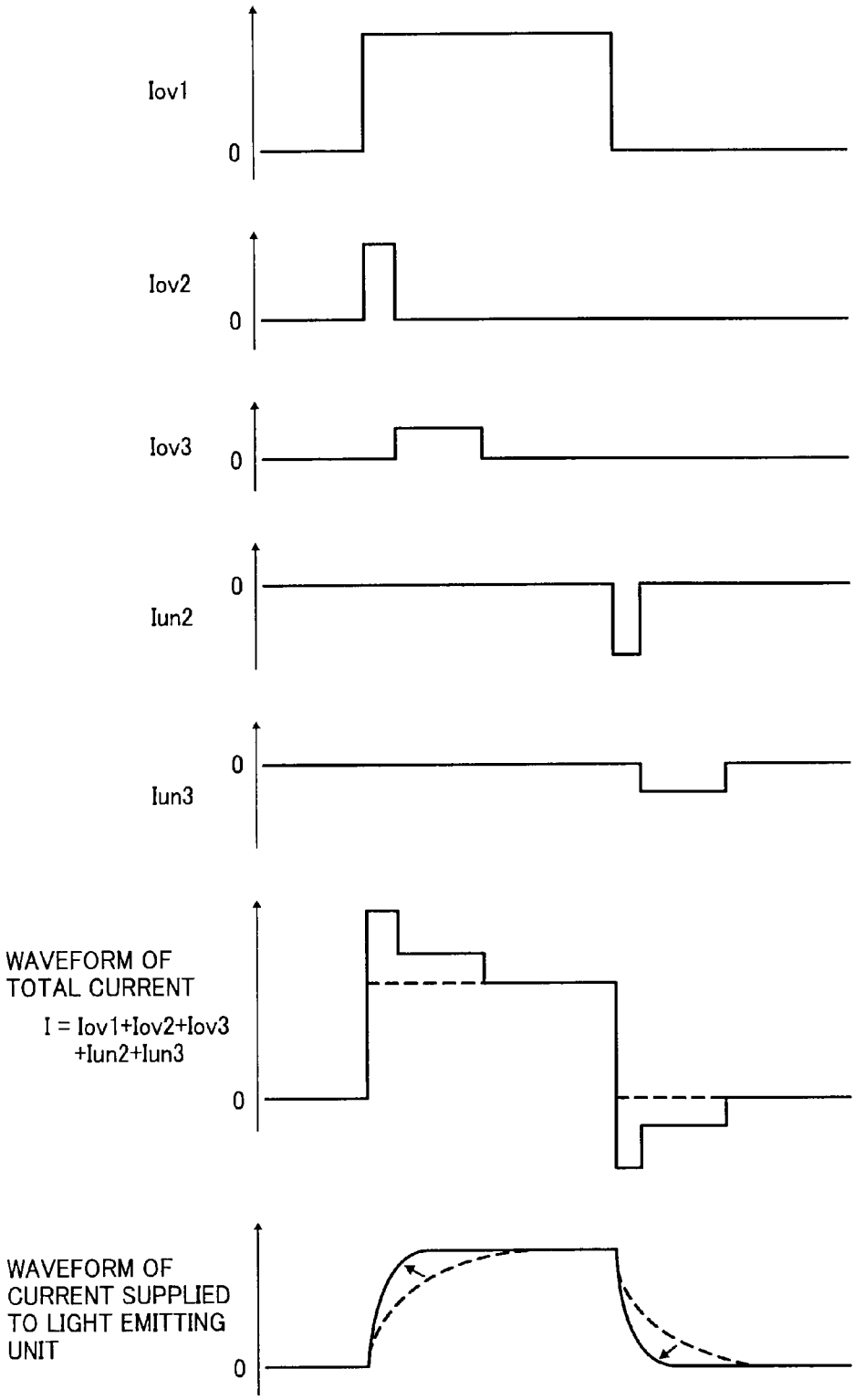
FIG. 19 is a schematic diagram for explaining a method of adding the overshoot current and the undershoot current in the light-source driving circuit shown in FIG. 18.
Figure 20:
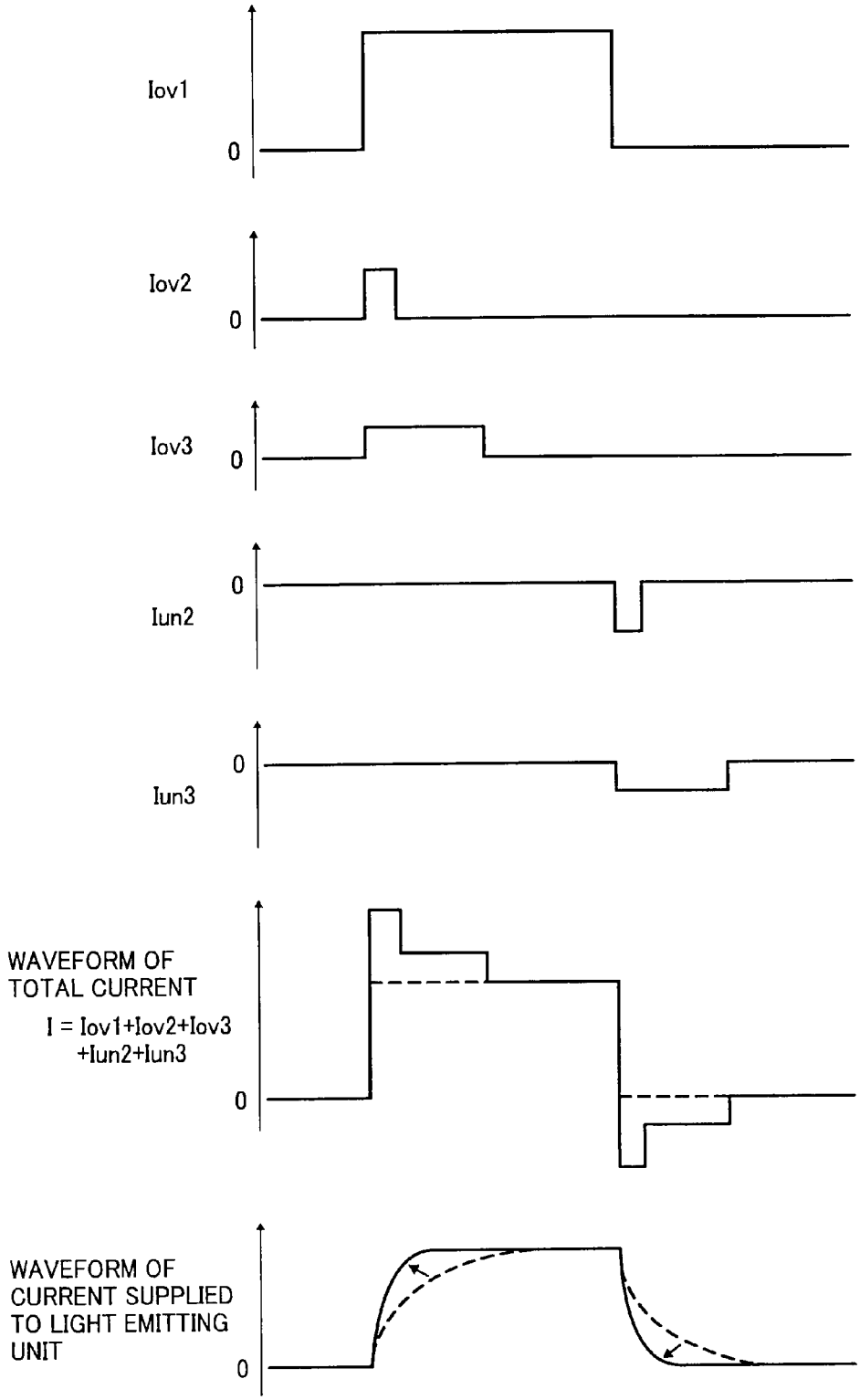
FIG. 20 is a schematic diagram for explaining another method of adding the overshoot current and the undershoot current in the light-source driving circuit shown in FIG. 18.

FIGS. 19 and 20 are schematic diagrams representing methods of adding the overshoot current and the undershoot current using the current-adding-type circuit. In this case, the current sources Iov1, Iov2, Iov3, and Iov4 are controlled by the overshoot-current control signal so that the total current I takes the maximum value just after the rise of the current and takes a predetermined value (a light emitting current determined according to the light emitting amount) as the time elapses, and the current sources Iun1, Iun2, Iun3, and Iun4 are controlled by the undershoot current signal so that the total current I takes the minimum value (negative) just after the fall of the current and becomes zero as the time elapses. Thus, the distortion of the current can be corrected in digital fashion.

FIG. 19 represents a case in which the current sources Iov2 and Iov3 are turned on at different timings, and the current sources Iun2 and Iun3 are turned on at different timings. FIG. 20 represents a case in which the current sources Iov2 and Iov3 are turned on at the same timings, and the current sources Iun2 and Iun3 are turned on at the same timings.

In the present embodiment, a VCSEL is used as the light source; however, for example, a laser diode (LD) outputting a red light can be used as the light source. A red laser diode has a high internal resistance.

Furthermore, in the present embodiment, the light source LA includes 32 light emitting units; however, the light source can include any number of light emitting units more than one. The light emitting units can be arranged in a line.

Moreover, in the present embodiment, the laser printer 1000 is used as the image forming apparatus; however, it is not limited to this. Any image forming apparatus including the optical scanning unit 1010 can form high-quality images at high speed.

For example, an image forming apparatus that includes the optical scanning unit 1010, and directly irradiates a photosensitive medium (e.g., a sheet) with a laser light, of which color is changed with irradiation of the laser light, can be used.

Alternatively, the image forming apparatus can be the one in which a silver halide film is used. In this case, a latent image is formed on the silver halide film by scanning with a light, and the latent image can be developed by performing a process that is the same as a developing process in a typical silver halide photographic process. Then, the developed latent image can be transferred onto a printing sheet by performing a process that is the same as a printing process in a typical silver halide photographic process. The image forming apparatus with such configuration can be employed as an optical plate making apparatus, a photolithographic apparatus for drawing a computed tomography (CT) scan image, or the like.

Figure 21:
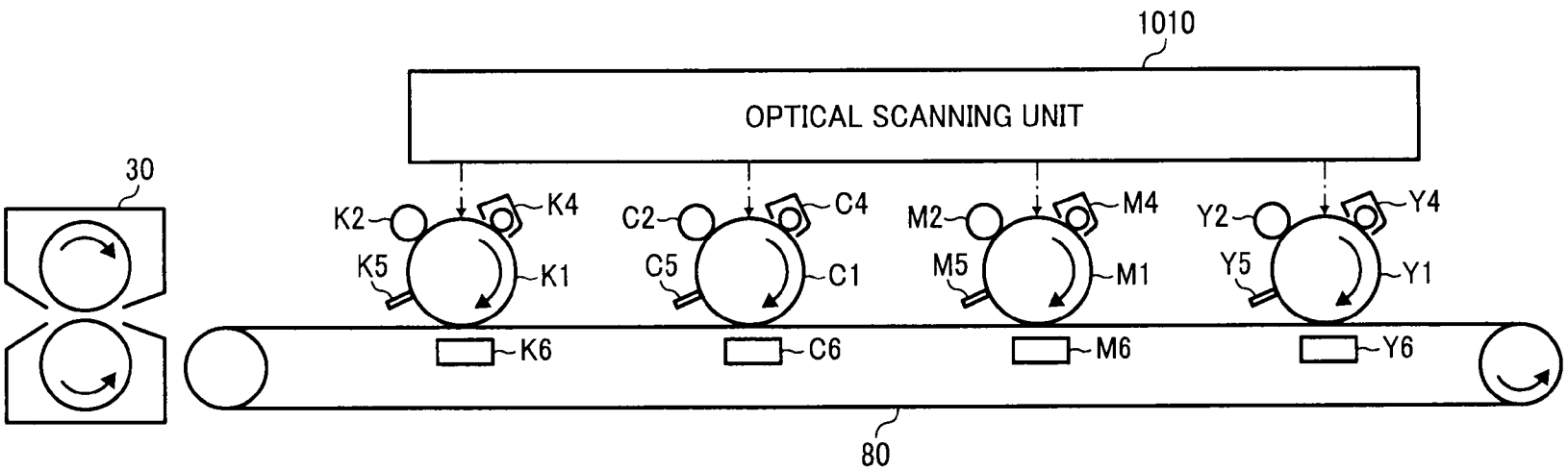
FIG. 21 is a schematic diagram of a tandem-type color printer.

The image forming apparatus can be a tandem-type color printer, which includes a plurality of photosensitive drums to form color images, as shown in FIG. 21 as one example. The tandem-type color printer includes a photosensitive drum K1 for black (K), a charging unit K2, a developing unit K4, a cleaning unit K5, a charging unit K6 for transfer, a photosensitive drum C1 for cyan (C), a charging unit C2, a developing unit C4, a cleaning unit C5, a charging unit C6 for transfer, a photosensitive drum M1 for magenta (M), a charging unit M2, a developing unit M4, a cleaning unit M5, a charging unit M6 for transfer, a photosensitive drum Y1 for yellow (Y), a charging unit Y2, a developing unit Y4, a cleaning unit Y5, a charging unit Y6 for transfer, the optical scanning unit 1010, a transfer belt 80, and a fixing unit 30.

The optical scanning unit 1010 includes light emitting units for black, cyan, magenta, and yellow.

Lights from the light emitting units for black, cyan, magenta, and yellow are radiated to the photosensitive drums K1, C1, M1, and Y1 through scanning optical systems for black, cyan, magenta, and yellow, respectively. The optical scanning unit 1010 can be provided for each color.

Each photosensitive drum rotates in a direction indicated by an arrow in FIG. 21. The charging unit, the developing unit, the charging unit for transfer, and the cleaning unit are arranged in this order in the direction indicated by the arrow. Each charging unit uniformly charges the surface of the corresponding photosensitive drum. The uniformly-charged-surface of each photosensitive drum is irradiated with a light from the optical scanning unit 1010, so that an electrostatic latent image is formed on the surface of each photosensitive drum. The latent image on each photosensitive drum is developed by the corresponding developing unit, so that a toner image is formed on the surface of each photosensitive drum. The toner image of each color is transferred onto a recording sheet by the corresponding charging unit for transfer, and then, four color toner images on the recording sheet are fixed thereto by the fixing unit 30.

According to one aspect of the present invention, because the overshoot current is added to the light emitting current that is determined according to the light emitting amount of each light emitting unit, the rise characteristics of the light emitting units at the time of emitting light can be equal to each other.

According to another aspect of the present invention, the optical scanning can be performed with high accuracy by using the light-source driving circuit.

According to still another aspect of the present invention, because the image forming apparatus includes at least one optical scanning unit, high quality images can be formed at high speed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A circuit for driving a plurality of light emitting units, the circuit comprising:

an overshoot-current generating unit that generates an overshoot current; and a current adding unit that biases a light emitting current that is determined based on an amount of light emitted from each of the light emitting units with the overshoot current, and supplies resultant current to each of the light emitting units, wherein the light emitting units and the driving circuit are accommodated in separate packages, the overshoot-current generating unit includes a resistance-capacitance circuit, which includes a resistor and a capacitor, that generates the overshoot current, and the current adding unit determines a resistance and capacitance of the resistance-capacitance circuit so that rise characteristics that are characteristic of light emitted from each of the light emitting units and depends on a difference in a time constant, the time constant being obtained based on a resistance of each of the light emitting units, a capacitance of each of the packages, and a coupling capacitance of each of wires, is equal among the light emitting units.

2. The circuit according to claim 1, wherein the overshoot-current generating unit generates the overshoot current by combining outputs from a plurality of current sources.

3. The circuit according to claim 1, wherein the overshoot-current generating unit includes a resistance-capacitance circuit, which includes a resistor and a capacitor, that generates the overshoot current.

4. The circuit according to claim 1, further comprising at least one of a resistance switching unit and a variable capacitance element to change a resistance-capacitance circuit constant of the resistance-capacitance circuit.

5. The circuit according to claim 1, wherein the current adding unit biases the light emitting current with an undershoot current.

6. An optical scanning device that scans a target surface with a light comprising:

a light source that includes a plurality of light emitting units;

a deflector that deflects the light emitted from the light source;

an optical system that focuses the light deflected by the deflector toward the target surface; and a circuit for driving the light emitting units, the circuit including an overshoot-current generating unit that generates an overshoot current; and a current adding unit that biases a light emitting current that is determined based on an amount of light emitted from each of the light emitting units with the overshoot current, and supplies resultant current to each of the light emitting units, wherein the light emitting units and the driving circuit are accommodated in separate packages; and the overshoot-current generating unit includes a resistance-capacitance circuit, which includes a resistor and a capacitor, that generates the overshoot current, and the current adding unit determines a resistance and the capacitance of the resistance-capacitance circuit so that rise characteristics that are characteristics of light emitted from each of the light emitting units and depends on a difference in a time constant, the time constant being obtained based on a resistance of each of the light emitting units, a capacitance of each of the packages, and a coupling capacitance of each of wires, is equal among the light emitting units.

7. An image forming apparatus comprising:

at least one image carrier; and at least one optical scanning device that scans the at least one image carrier with alight carrying image data, the optical scanning device including a light source that includes a plurality of light emitting units;

a deflector that deflects the light emitted from the light source;

an optical system that focuses the light deflected by the deflector toward the at least one image-carrier; and a circuit for driving the light emitting units, the circuit including an overshoot-current generating unit that generates an overshoot current; and a current adding unit that biases a light emitting current that is determined based on an amount of light emitted from each of the light emitting units with the overshoot current, and supplies resultant current to each of the light emitting units, wherein the light emitting units and the driving circuit are accommodated in separate packages; and the overshoot-current generating unit includes a resistance-capacitance circuit, which includes a resistor and a capacitor, that generates the overshoot current, and the current adding unit determines a resistance and the capacitance of the resistance-capacitance circuit so that rise characteristics that are characteristics of light emitted from each of the light emitting units and depends on a difference in a time constant, the time constant being obtained based on a resistance of each of the light emitting units, a capacitance of each of the packages, and a coupling capacitance of each of wires, is equal among the light emitting units.

8. The image forming apparatus according to claim 7, wherein the image data is a data of a multiple color image.

* * * * *